US009597702B1

(12) United States Patent
Ciervo

(10) Patent No.: US 9,597,702 B1
(45) Date of Patent: Mar. 21, 2017

(54) ULTRASONIC COSMETIC APPLICATOR

(71) Applicant: Donald John Ciervo, Merrick, NY (US)

(72) Inventor: Donald John Ciervo, Merrick, NY (US)

(73) Assignee: Sonaer, Inc.

( * ) Notice: Subject to any disclaimer, the term of this patent is extended or adjusted under 35 U.S.C. 154(b) by 0 days.

(21) Appl. No.: 15/066,110

(22) Filed: Mar. 10, 2016

Related U.S. Application Data

(63) Continuation-in-part of application No. 14/045,231, filed on Oct. 3, 2013, now Pat. No. 9,282,803.

(51) Int. Cl.

| | |
|---|---|
| ***B05B 17/06*** | (2006.01) |
| ***A45D 34/04*** | (2006.01) |
| ***B05B 7/24*** | (2006.01) |
| ***B05B 1/32*** | (2006.01) |

(52) U.S. Cl.
CPC ..... *B05B 17/0676* (2013.01); *A45D 34/04* (2013.01); *B05B 1/32* (2013.01); *B05B 7/244* (2013.01); *B05B 7/2478* (2013.01)

(58) Field of Classification Search
CPC ..... B05B 17/063; B05B 17/0623; B05B 17/0646; B05B 17/06
USPC ..... 239/102.1, 102.2, 302, 375, 376, 345; 604/22, 68; 601/2, 15, 17; 128/200.16
See application file for complete search history.

(56) References Cited

U.S. PATENT DOCUMENTS

| | | | | |
|---|---|---|---|---|
| 4,877,989 | A * | 10/1989 | Drews | B05B 17/0623 128/200.16 |
| 6,569,099 | B1 * | 5/2003 | Babaev | A61M 3/0275 600/437 |
| 6,663,554 | B2 * | 12/2003 | Babaev | A61M 11/005 600/2 |
| 6,964,647 | B1 * | 11/2005 | Babaev | A61M 11/005 601/2 |
| 8,061,629 | B2 * | 11/2011 | Tranchant | A45D 34/02 239/102.2 |
| 8,096,489 | B2 * | 1/2012 | Fedorov | B05B 1/3013 239/345 |
| 8,720,435 | B2 * | 5/2014 | Gallem | A61M 11/005 128/200.14 |
| 2009/0043248 | A1 * | 2/2009 | Peterson | A61B 17/20 604/22 |

* cited by examiner

*Primary Examiner* — Arthur O Hall
*Assistant Examiner* — Tuongminh Pham

(57) ABSTRACT

A portable ultrasonic cosmetic applicator for spraying lip gloss, eye shadow, blush, tanning solutions, moisturizing agents, and sterilants onto the body or face. Useful for wound healing, makeup artists in the movie industry, beauty salons, and for personal use. The applicator is small and lightweight thus making it easy to use without the use of external air pressure more commonly used with airbrush spraying equipment of this type. Noisy compressors, pressurized cylinders and air lines are all eliminated. The amount of unused solutions are reduced due to its ability to produce a smaller and more uniform droplet size which, in turn, produces a fine misty spray unlike some of the more traditional applicators. Due to its lack of complexity and awkwardness, the user is able to apply liquid in a simple and graceful manner.

4 Claims, 7 Drawing Sheets

ULTRASONIC COSMETIC APPLICATOR

BACKGROUND OF THE INVENTION

Cosmetics have been around for over 3000 years. The Egyptians were the first to use pigments, crushed berries and leaves, and the upper class would purchase makeup from incoming travelers. This not only cost a great deal of money for that time period, but took up to a month or longer to make. At first, men would use makeup by applying galena or kohl (black eye-liner) to create an "almond shaped eye" which resembles the Falcon Eye of the God Horus. Women then began to experiment with the use of cosmetics. These substances were applied with a small stick or wooden needle having an enlarged end, creating a cotton bud shape. Along with black eye-liner, the men of ancient Egypt applied green eye shadow/paints, and a lip balm or salve colored with natural earth pigments, such as red ochre.

It was said that the natives believed makeup would ward off evil spirits and protect against eye diseases and ocular infections caused by the Nile River. Kohl promoted the production of nitric oxide in the skin which strengthened their immune systems. In addition, they soon learned that the soot found in kohl helped to reduce the damaging effects of sun glare on the eyes. After the ancient Egyptians discovered the use of cosmetics, word began to spread and new ideas began to form.

Airbrush, in general, was first established by a man named Abner Peeler in 1879 by using mostly spare parts from a jewelers workshop. Four years later, a company by the name of Liberty Walkup began marketing his invention. In 1893, Thayer and Chandler art materials presented the first known modern airbrush at the World's Columbian Exposition in Chicago. At the time, the airbrush invention had the sleek look of a pen and its functionality was extremely similar to recent airbrush machines in today's society. 1958 began the production of the film Ben-Hur which was completed in 1959 by MGM Studios. Cosmetics were applied using airbrush during the set of this world renowned film. Makeup artists were instructed to apply faux tans for the thousands of actors who played minor roles acting the part of Romans. The idea of using airbrush to apply a makeshift foundation worked surprisingly well. It was found that by using an airbrush, one can spray cosmetics more precisely, lighter, and more efficiently. Airbrush soon became a popular method of applying cosmetics in Hollywood studios in the mid 1970s. Soon, it made its way into hair and beauty trade shows, and the Bal Masque competitions. Nowadays, airbrush is commonly used for creating temporary tattoos, conventional makeup, fantasy makeup, body art, fingernail art, hair color, and airbrush tanning.

Sonaer has been making ultrasonic atomizers nozzles since 1997. An ultrasonic atomizer nozzle works by the same principal of wave motion as all other ultrasonic devices such as liquid processors, welders, surgical tools, dental instruments, and the like. It is no secret that an atomizer nozzle is any one of the above-mentioned devices, its only difference being that it is made with a hole through the center, or a plurality of holes for spraying a liquid. One of the benefits of using an atomizer nozzle, is the fact that finer droplets are easily produced, spray is more uniform with a narrow droplet distribution, and the application of liquid is more efficient when expelled from the tip end—all this without the use of air pressure. Knowing the advantages of an atomizer nozzle design and function, I have invented a cosmetic applicator that contains within an ultrasonic atomizer nozzle that does not include the center hole. Along with the atomizer nozzle, I have invented an applicator handpiece that includes a method of threading a small bottle of solution to the top of the applicator. The solution can be any liquid being sprayed. At the rear of the applicator is an elastic bulb for applying a small amount of pressure within the bottle forcing the solution inside to move through a small orifice within the applicator to the atomizer tip. Contained along the side of the applicator is a method of turning on the ultrasonic power, opening a valve for solutions to be sprayed, and a mechanism for disabling all functions when released. This is truly a unique and novel method for spraying cosmetics and other solutions since it is small, lightweight, and contains all necessary functions of delivering solutions to the tip end without a liquid pump, compressed air supply, tubing, or the necessity of an electric supply as is commonly used in other inventions. It is portable and, therefore, perfect for treating wounds in deserts, mountains, jungles and far reaches of the world where there may be no electricity. It is also very useful for quick and accurate spraying of tanning solutions, and cosmetics, with the device able to be pointed up, down, or held on its side without spilling. This is why the invention I disclose is unique and novel, and is not inherent in the inventions presented by Peterson, Federov and Tranchant identified below.

In reference to Peterson et al, Removable Multi-Channel Applicator Nozzle, publication US 2009/0043248, dated Feb. 12, 2009 demonstrates an ultrasonic device with a delivery well and ultrasonic generator for making sprays from liquids. Although this device can spray liquids, we have found that a gravity feed is insufficient in regulating the flow of solution to the tip of the atomizer nozzle. In part, the top of the fluid source (114) needs to maintained level to the ground at all times and open to prevent air from being trapped and help promote flow. Any tilting or tugging of the transducer assembly (108) will create a potential of solution being spilled. A method of preventing spillage is to fix the fluid source upright and include a longer tubing (116). As with all devices with cords and tubing, these devices are fairly limited in their ability to maneuver without it getting in the way of the task at hand. Inventors can modify Peterson's device and configure a cart with wheels to house the generator (119) and fix the fluid source (114). It would prove to be quite cumbersome to use this equipment in an environment with irregular terrain such as a battlefield or outside where there is no electricity to plug into.

The invention I am disclosing alleviates all of the shortcomings in Peterson's invention with the ability to freely move about in offices and outside without the need for carts, gravity feed, cords, tubes or plug-in electricity. One can take my invention presented and spray solutions anywhere quite easily, and when finished, simply place it in a shirt pocket due to its novel design and structural differences presented in this disclosure.

Referring to Federov, Spraying Device Apparatus, U.S. Pat. No. 8,096,489 B2, dated Jan. 17, 2012 demonstrates an air brush (10) with a valve switch plate or trigger (30) that pivots on pair of projections (60) to move a needle (48) within an air chamber (33) releasing fluid in a tank (34) and air pressure through air connector (40) to spray solution through a nozzle (22) with spring (84) closing the device when released. At first glance the device appears to be no more than a spray gun for painting automobiles with injection molded parts that look complex. The invention presented does encompass some features presented in my invention. By using laser light, the scattering and measuring of droplets produced with compressed air devices are larger than droplets produced by ultrasonic devices with a very wide distribution of droplets. In general, finer more uniform droplets will cover objects with softer smoother surfaces, and can be applied to areas that are narrow such as within fine lines and wrinkles, or into cellular layers to promote healing. The invention Fedorov discloses uses compressed air delivered via a compressor. Since in order to spray droplets through this type of nozzle, significantly higher pressure is required to atomize liquid (perhaps as high as 40-60 PSI), which requires an air line thus making this invention not portable. In addition, Federov's invention requires a hose making it cumbersome to use, and relies on electricity, therefore making it difficult to operate in remote areas. What I disclose, needs very low pressure integrated within the device by use of a elastic bulb and provides pressures typically around 1-2 PSI, facilitating spraying with its soft spray droplets. Another feature I am disclosing is the ability to change bottles of solution easily, without the need to clean the tank as in Federov's invention. Yet another feature I disclose is the presence of a valve switch plate that encompasses both a method of releasing solution to the atomizer probe tip, which enables electrical connection to the ultrasonic device, and has a method of closing the flow of solutions all integrated into one simple mechanism. Federov does not demonstrate this ability of a multi-functional mechanism.

Referring to Tranchant et al, Spray Device Having A Piezoelectric Element, And Use Thereof In Cosmetology And Perfumery, U.S. Pat. No. 8,061,629 B2, dated Nov. 22, 2011 discloses an ultrasonic device with a reservoir (2), wick (7), spray head assembly (3). Within the spray head (3) is a sonotrode (14). Solution is pulled through the wick (7) up to the vibrating sonotrode (14) and atomized. The piezoelectric element (13) is in the order of 1.7 mm. This configuration with the wick (7) is made like a loop and allows only a thin film of solution to be atomized, it is, therefore, not useful for large areas to be covered, as the body. However, Tranchant's invention is useful for small volumes of solutions to be deposited, like expensive perfumes. Tranchant's invention is required to operate level to the ground, preventing over saturation of the wick (7) rendering it not operational, should it become saturated. In addition, fluids are not interchangeable since the wick (7) is fixed and is not designed to be rugged for rough environments.

The invention I am disclosing alleviates the shortcomings of the above-cited previous inventions due to its multi-functional lever mechanism; its interchangeable bottle containing solutions; its absence of compressed air supply which eliminates cords, pumps, and tubes; its ability to operate in various environments due to its lightweight nature, along with its ability to be held upright, on an angle, or upside down without the possibility of leakage.

OBJECT AND SUMMARY OF THE INVENTION

The object of the invention is to use the latest formulation of cosmetics or solutions to efficiently spray and direct small uniform droplets onto the skin's surface. It is also the object of the disclosed invention to complete the above-mentioned task without the use of an air hose, pressurized cylinder, pump, or compressor as is commonly used with airbrushing or atomization. Airbrushing is considered to be state-of-the-art in applying today's cosmetics. Normally, with an airbrush, paint or cosmetic is held in a glass container attached to the handpiece that is shaped like a pen and is easy to hold, just like Federov's invention. A compressor located in an area away from the user supplies pressurized air to the airbrush through a tube attached to the airbrush handpiece. A button is pressed activating a valve to direct air to the tip of the handpiece. This is used to pick up the solution or cosmetic to be sprayed. The liquid air mixture leaves the airbrush with a velocity and angle based on the pressure and tip configuration. The user has to constantly maneuver the airbrush to keep the tube from getting in the way of the subject being covered.

Atomizer nozzles that Sonaer makes have piezoceramics sandwiched between two end masses. The ceramics convert an alternating voltage applied to the ceramics to mechanical motion. This motion is amplified by the shape of the end mass or tip. Usually, a smaller diameter end mass amplifies the motion of the ceramics and a larger diameter end mass reduces the motion. Through the center of the atomizer nozzle is an orifice with a means of connecting a liquid line at the back of the nozzle. As liquid is pumped through the center of the probe, mechanical vibrations like that of a piston, pulverize the liquid into a fine droplets. Many droplets that reach the tip are formed into a spray. The sprays for this type of atomization are known to be finer and more uniform than air pressurized, water pressurized, and all other methods of mechanical spray. The fine spray is derived from the frequency of the nozzle. Typically, a nozzle with a higher frequency makes a smaller droplet size than one of a lower frequency. Any atomizer nozzle in the frequency range of 20,000 Hz and higher will make smaller droplets than a mechanical device that spins or vibrates at a frequency lower than 20,000 Hz, including air and liquid assisted atomization.

With the invention I am presenting, the user does not have to worry about an awkward air supply tube which will get in the way, or the adjustment of air pressure to the airbrush. Atomizer nozzles which function with liquid being pumped through the center are also not needed. Using skills learned in the trade of airbrushing cosmetics, this invention alleviates the obstacles of conventional airbrushing and atomization, and allows the applicant to create a soft delicate spray of material that is uniform and soothing by using the principals and properties of ultrasonics. The proposed cosmetic applicator is small and portable and has within a means to provide a small amount of air pressure along with other mechanisms which work in unison to create an improved method for spraying solutions. A further understanding of this invention will be better realized by the detailed description of the embodiments below.

DETAILED DESCRIPTION OF THE EMBODIMENTS

Figure 1:
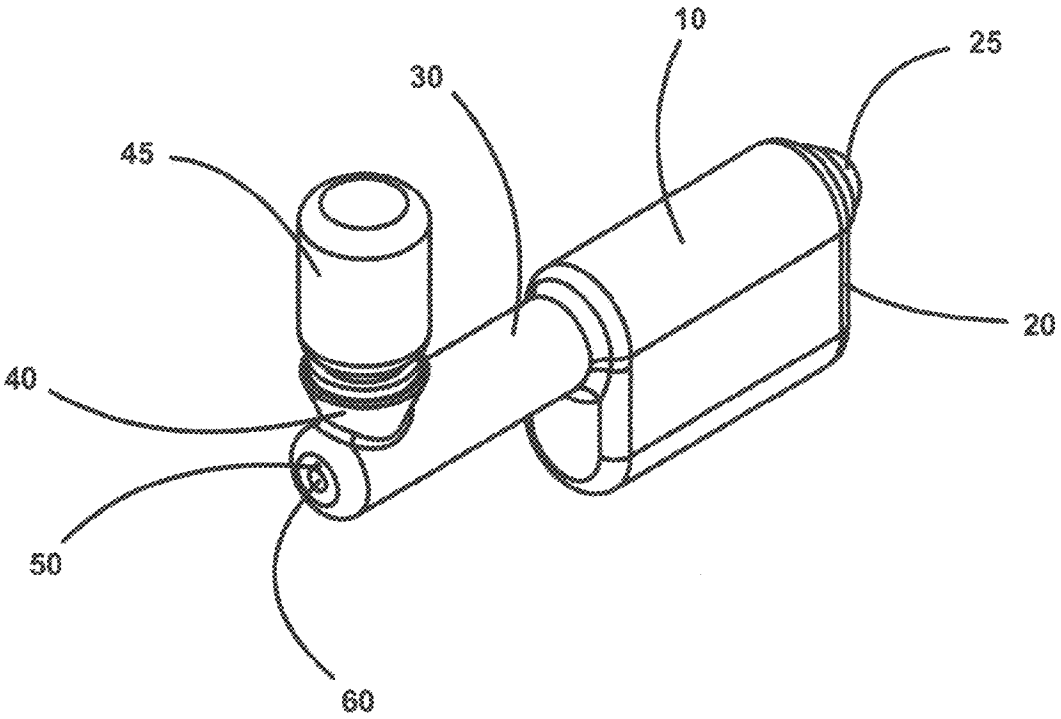
FIG. 1 is an overall view of the disclosed cosmetic applicator according to the invention and external embodiments for spraying cosmetics and solutions onto the face and body.

Referring now to the drawings wherein like reference characters designate like or corresponding parts throughout, there is illustrated in FIG. 1, an ultrasonic cosmetic applicator 10 for spraying atomized droplets made from cosmetic materials and solutions, onto the body or face. The cosmetic applicator 10 has a back cover 20 which covers the internal components and helps with assembly. It has attached an elastic bulb 25. The elastic bulb 25 is pressed by the users finger to apply a small pressure into the bottle 45. This pressure aids in spraying the material emitted from the distal end 60. Internal components within the cosmetic applicator 10 are loaded from the back cover 20 of the cosmetic applicator 10 up to the distal end 60 where they are secured inside the unit. Along the length of the cosmetic applicator 10 is the frontal control mechanism 30. The frontal control mechanism 30 contains many features that make the cosmetic applicator 10 function as will be further discussed. At the distal end 60 is a liquid delivery well 40 that has a means of securing a bottle 45. The bottle 45 contains the cosmetic material or solution to be sprayed. At the bottom of the liquid delivery well 40 and moving to the distal end 60 is a liquid delivery orifice 50 and a air inlet orifice, not shown in this drawing. The liquid delivery orifice 50 directs the cosmetic to the distal end 60 from the liquid delivery well 40 where the liquid is made into droplets for spraying. Once the liquid delivery well 40 is filled with cosmetic liquid or solution from the bottle 45, the unit is ready to spray cosmetics and or solutions onto the body and face.

Figure 2:
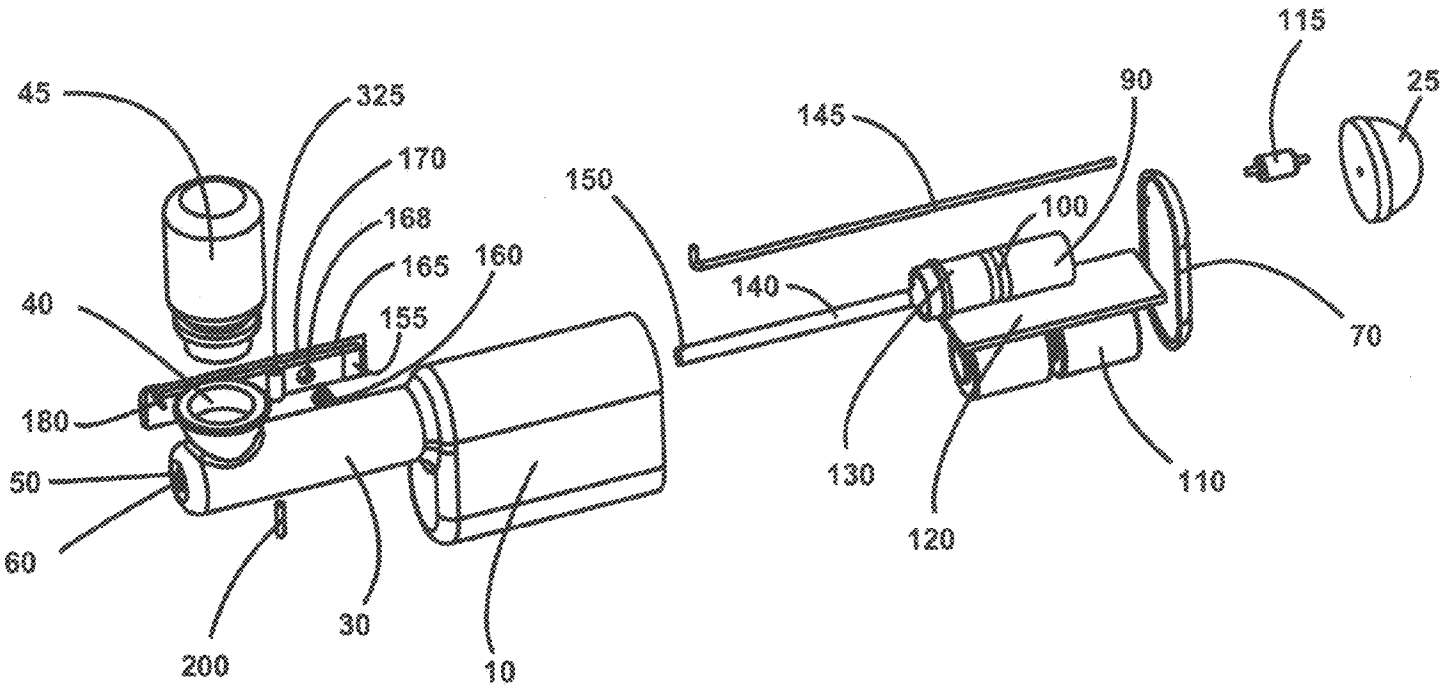
FIG. 2 is a view of the cosmetic applicator components required for the invention to spray solutions using an ultrasonic atomizer without external devices such as pumps, tubing or compressors.

In reference to FIG. 2 of the disclosed invention presented, is a detailed view of the components necessary for this device to operate as a handheld unit without air pressure, and or pumps or compressors that is commonly used with an airbrush as we have seen by the other inventions. The main body of the cosmetic applicator 10 contains within several main components that enable this device to work. The cosmetic applicator 10 has within an atomizer device 130, an air tube 145, a one way check valve 115, a circuit board 120, and batteries 110. External to the cosmetic applicator 10 is a valve switch plate 170 along with associated parts such as a back cover 20, elastic bulb 25, and a bottle 45, which make up the bulk of components needed for this invention to work. The atomizer device 130 is a typical sandwich transducer that has been is well-known since the 1960's. It is made up of three basic components. The first is the center piezoelectric ceramics 100 compressed between two end masses. These end masses are labeled the rear driver 90 and the front driver 140. Together they make up a resonant body which vibrates at ultrasonic frequencies. Typically these frequencies are between 20,000 cycles per second, and up as high a 500,000 cycles per second. These three component parts make up the ultrasonic atomizer device 130 and is well known in the industry. This application will not focus on the atomizer device 130 and will only be discussed briefly since this application is not teaching anything that is not already known in the field of ultrasonics. To power the ultrasonic atomizer device 130 is a driver circuit board 120 with integrated circuit chips that make up an oscillator, power amplifier, and control circuit all of which are also well known. Energy to operate the system is derived from batteries 110, and all the component parts listed above are enclosed into the cosmetic applicator 10, by use of a rear cover 20. The focus of this invention will be how the following pieces work together: The valve switch plate 170, and how it works with the bottle 45 containing the cosmetic or solution, the elastic bulb 25, one way check valve 115, the air tube 145 and the distal end 60 of the atomizer.

First we will examine the valve switch plate 170 and how this piece functions in conjunction with liquid delivery and ultrasonic atomization. The valve switch plate 170 has a valve pin 180 attached and is actually a part of the valve. During assembly, the valve switch plate 170 is secured to the cosmetic applicator's 10 frontal control mechanism 30 by use of a roll pin 200, and a through-hole 325. This method allows the valve switch plate 170 to pivot like a seesaw at the point where the roll pin 200 connects to the cosmetic applicator's 10 frontal control mechanism 30 via through-hole 325. A spring 160 is placed between the valve switch plate 170 and the frontal control mechanism 30 into a counter bore 168. The spring 160 is secured in position while operating the cosmetic applicator 10 with the assembly of the roll pin 200 into hole 325. While applying a force to the side 165 of the valve switch plate 170 opposite the spring 160, the valve pin 180 will move away form the frontal control mechanism 30 of the cosmetic applicator 10. With this force applied by the user, the spring 160 compresses, the valve switch plate 170 pivots, and valve pin 180 slides inside the frontal control mechanism 30 of the cosmetic applicator 10. The valve switch plate 170 is kept in place in the frontal control mechanism 30 with the valve pin 180 mounted in the valve relief hole 270 (Shown in FIG. 2.). As one side of the valve switch plate 170 goes up the other goes down and vice-versa. During this period of movement, the valve pin 180 of the valve switch plate 170 will open and close a liquid delivery orifice 50 that bridges from the front portion 60 and the liquid bottle 45. With the valve switch plate 170 open, cosmetics or solutions will flow through the orifice 50 from the bottle 45 onto the distal tip 150 of the atomizer device 130 which is flush with the distal end 60. At the same time the valve switch plate 170 opens, contact 155 engages connection in the frontal control mechanism 30 enabling power to the driver circuit board 120, which in turn powers up the atomizer device 130 creating ultrasonic vibration and atomization of the liquid deposited on the distal tip 150 at the distal end 60 of the cosmetic applicator 10.

Another component of the disclosed invention is the pressurizing mechanism. This is comprised of the elastic bulb 25, one way check valve 115 and the air tube 145. Each component part is fixed to one another to prevent any air leaks during use. The air tube 145 is fixed to the one way check valve 115, the one way check valve is firmly fixed to the elastic bulb 25, and the elastic bulb 25 is fixed to the rear cover 20 of the cosmetic applicator 10. Before cosmetics or solutions can be sprayed, the bottle 45 needs to be pressurized. This is accomplished by the user by placing his or her finger onto the elastic bulb 25. Squeezing or pushing the elastic bulb 25 towards the rear cover 20, compresses air within a cavity made in the bulb. This air is injected through the one way check valve 115, then through the air tube 145 mounted inside frontal control mechanism 30 of the cosmetic applicator 10, and is then deposited within the liquid delivery well 40 as it pressurizes the cosmetic or solution within the bottle 45. The pressure is maintained within the bottle 45 due to the design of the one way check valve 115. Just as the name means the one way check valve 115 only allows air to move through in one direction and not through in the opposite direction. This air that pressurizes the bottle 45 is maintained and is sealed to prevent leaking. After the user pressurizes the bottle 45 by compressing the elastic bulb 25, the unit is ready for use. The user can now grip the body of the cosmetic applicator 10 with the one's finger against the side 165 of the valve switch plate 170. Pressing the side 165 moves the valve switch plate 170 towards the frontal control mechanism 30 by a pivoting action. This pivoting action creates electrical contact 155 with contacts inside of the frontal control mechanism 30 (not shown in this view), thus energizing the atomizer device 130. At the same time the valve pin 180 moves away from the frontal control mechanism 30, opening a pathway from the bottle 45 and the liquid delivery orifice 50. Pressure built within the bottle 45, forces cosmetics or solution through the liquid delivery orifice 50 and onto the distal tip end 150 of the atomizer device 130 where vibration produced by the atomizer device pulverizes the solution into uniform nano and micron droplets. These droplets are small and uniform and are easily deposited onto the skin's surface with a velocity produced by two components. The first component is the release of pressurized cosmetic or solution produced inside the bottle 45, and the other is the velocity generated by the atomizer device which equals $2\pi fA$, where f is the frequency of the atomizer device 130, and A is the amplitude of the atomizer device 130 at the distal tip end 150. The combination of the two forces produced is great enough to spray droplets onto the surface of the skin, provide excellent coverage, more uniform droplet size with a narrow distribution, thus making the invention I am disclosing portable by nature, and able to be used in various environments.

Figure 3:
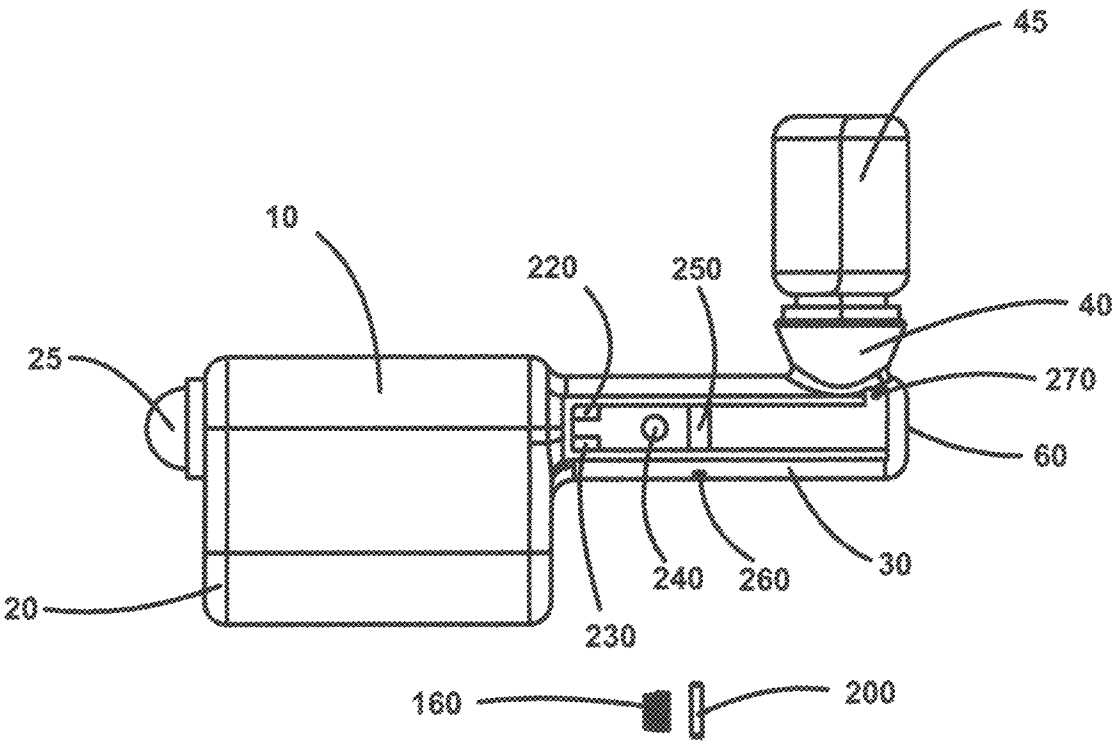
FIG. 3 is a side profile of the invention illustrating the valve switch combination used to activate the atomizer nozzle and open a valve allowing cosmetics to be deposited onto the atomizer tip, and air pressure bulb for applying a small pressure into the solution bottle.
Figure 4:
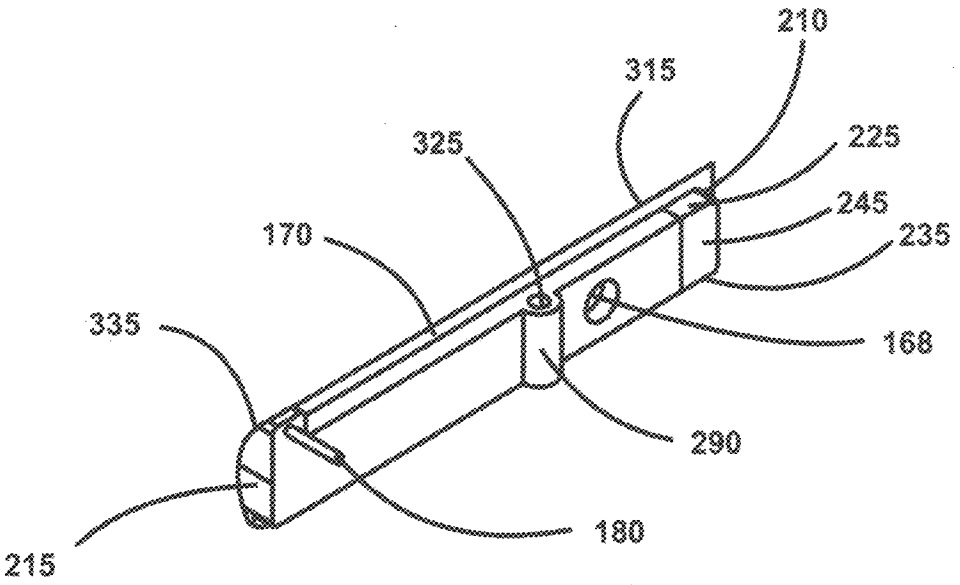
FIG. 4 is the valve switch plate which includes the valve pin, electrical contact and features required for spraying cosmetics and solutions.

In reference to FIG. 3 and FIG. 4 of the disclosed invention is a side profile of the cosmetic applicator 10, beneath that a spring 160, a roll pin 200, and a valve switch plate 170 (FIG. 4). These are the components that make up the valve and switch connection that activates ultrasonic power creating atomization from cosmetics and solutions by releasing them from the bottle 45. Reviewing the cosmetic applicator 10, there are two electrical connections 220 and 230 built into the frontal control mechanism 30. One has a wire connection to the printed circuit board inside the unit, and one to the batteries, as shown in FIG. 2. When contact is made between the electrical contact 220, 230 and 245 (Shown in FIG. 4.), power from the batteries energize the PCB which in turn powers up circuits and thus causes the atomizer device to vibrate. On the right of the electrical connections 220 and 230 of the frontal control mechanism 30, is a counter bore 240, a pivoting slot 250, and roll pin hole 260. Moving further to the right of the pivoting slot 250 is the liquid delivery well 40 and the valve relief hole 270. On top of the liquid delivery well 40 is the bottle 45 containing the cosmetics or solutions. In FIG. 4, the valve switch plate 170 has made within a valve pin 180, a pivoting boss 290, a counter bore 168, and electrical contact 245. The electrical contact 245 has a top portion 225 and a bottom portion 235. Distance between the top portion 225 and the bottom portion 235, bridges electrical connections 220 and 230 of the frontal control mechanism 30. Fitment of these components and how they function will be better understood further in this disclosure. The valve switch plate has a distal end 210, and a near end 215. On the near end 215 is a valve pin 180. On the distal end 210, is an electrical contact 245. The construction of the valve switch plate 170 is typically plastic, thus making it low cost and easily made by injection molding. The valve switch plate 170 on the near end 215 has a valve pin 180 that fits into a valve relief hole 270 within the frontal control mechanism 30. Between the near end 215 and the distal end 210 of the valve switch plate 170 is a counter bore 168. The counter bore 168 aligns evenly with the counter bore 240 within the frontal control mechanism and fitted within counter bores 168 and 240 is a spring 160. Fixing the valve switch plate 170 to the frontal control mechanism 30 is accomplished by aligning hole 325 with the roll pin hole 260 and inserting the roll pin 200 securing the two pieces together. With the assembly fitted together the valve switch plate 170 can now move in a out as a lever with a fulcrum. The lever is the valve switch plate 170 and the fulcrum is the pivoting boss 290 shown on the valve switch plate 170. As one side 315 of the valve switch plate 170 moves in, the opposite end 335 moves out. When the one side 315 of the valve switch plate 170 moves in, the spring 160 compresses and contact is made between electrical contacts 245, 220, and 230 energizing the system. At the same time, the valve pin 180 is pulled out from the valve relief hole 270 opening an orifice causing the cosmetic or liquid to flow, which is made into a mist or spray. Releasing the side 315 of the valve switch plate 170 will push the side 315 away from the electrical contact 220 and 230 and at the same time push in the valve pin 180 back into the valve relief hole 270 closing the flow of cosmetic or liquid and shutting off the spray. The invention I am disclosing demonstrates the uniqueness of the design due to it multi-functional fulcrum mechanism which enables ultrasonic energy to open a valve for easily spraying cosmetics and solutions.

Figure 5:
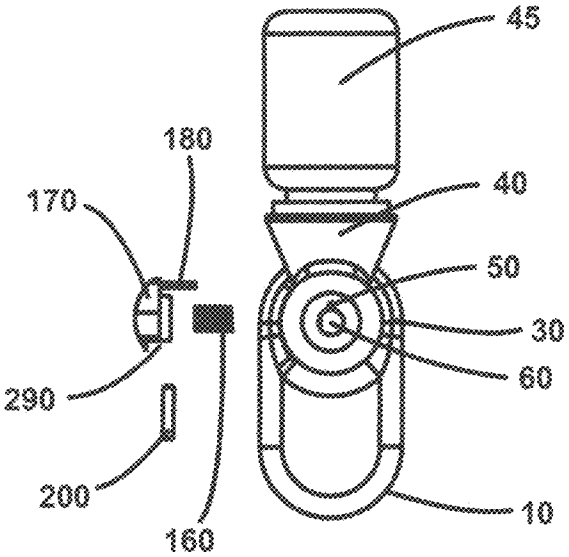
FIG. 5 is a front view of the disclosed invention showing the tip portion of the cosmetic applicator and mechanism for spraying solutions.

In reference the FIG. 5 of the disclosed invention is a front view of the cosmetic applicator 10. Located on the top of the cosmetic applicator 10 is a bottle 45. The bottle 45 contains cosmetics or solutions to be sprayed. The bottle 45 is attached to the cosmetic applicator by screwing into a liquid delivery well 40 built into the frontal control mechanism 30. The frontal control mechanism 30 encompasses the valve switch plate 170, the spring 160 and the roll pin 200. Located on the distal end 60, of the front portion of the frontal control mechanism 30 is the liquid delivery orifice 50 and flush with the distal end 60 is the distal tip end 150 of the atomizer device 130 as shown in FIG. 2.

Figure 6:
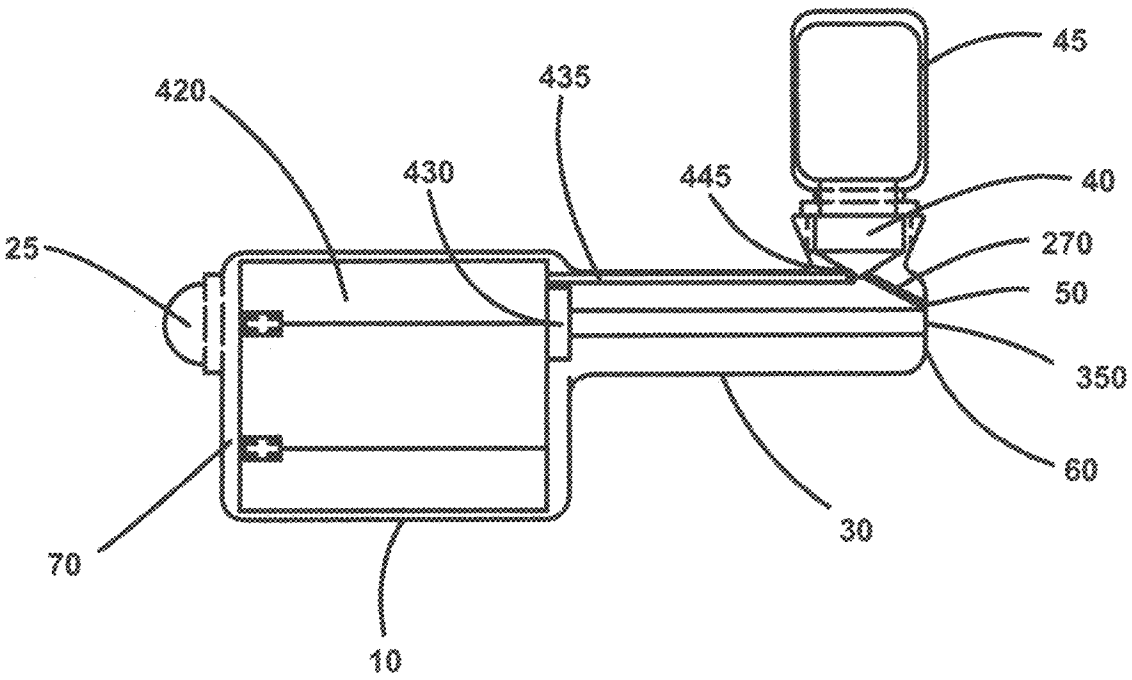
FIG. 6 is a cross section through the center of the cosmetic applicator exemplifying the internal orifices housing the atomizer device, electronics compartment, introduction of air pressure within the solution bottle, the valve, and the delivery orifice.

In reference to FIG. 6 of the disclosed invention is a cutaway side view of the cosmetic applicator 10. It has within an electronics compartment 420, transducer channel 430, an air channel 435 which leads into another air channel 445, which leads into a liquid delivery well 40, and then into a bottle 45. The cosmetic applicator 10 has a distal end 60 and a rear cover 20. Attached to the rear cover 20 is an elastic bulb 25. On the distal end 60 is a liquid delivery orifice 50 with a valve relief hole 270. The valve relief hole 270 is located between the distal end 60 of the frontal control mechanism 30 and the liquid delivery well 40. Through the transducer channel 430 the distal tip end 150 of the atomizer device 130 (shown in FIG. 2) is secured flush with the distal tip portion 350. Before cosmetics or solutions can be sprayed, the elastic bulb 25 is pressed to force air through air channel 435 and into air channel 445, which in turn enters the liquid delivery well 40 and pressurizes the bottle 45 that contains the liquid. When the valve switch plate 170 (shown in FIGS. 2 and 4) is pressed, the valve pin 180 moves within the valve relief hole 270, opening the pathway from the bottle 45 attached to the liquid delivery well 40 and directly into the liquid delivery orifice 50. The pressure within the bottle 45 forces the solution out of the bottle 45 and through the liquid delivery orifice 50 and is then deposited onto the distal tip portion 350 where atomization takes place. Releasing the valve switch plate shuts all functions off and is ready for the next spraying routine.

Figure 7:
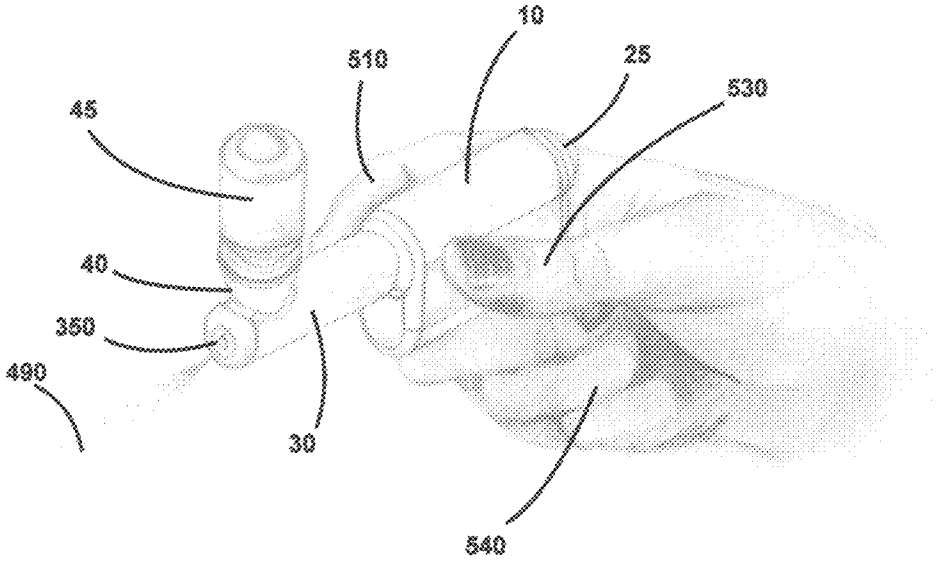
FIG. 7 is a artist's drawing of the cosmetic applicator being used for the spraying of liquid material.

Lastly in reference to FIG. 7 of the cosmetic applicator 10 shows the unit held in ones hand 540 between the thumb 530 and the index finger 510. After attaching the bottle 45 containing cosmetic, the index finger 510 is used to press the valve switch plate 170 to activate the ultrasonic atomizer device 130 both shown in FIG. 2. If one is left handed, the thumb is used to activate the cosmetic applicator 10. While activating the cosmetic applicator 10, cosmetics within the liquid delivery well 40 will flow to the distal tip portion 350 where it is atomized into fine droplets 490. The fine droplets 490 are smaller than airbrush sprayers thus less solution is used during the application process. The closer the cosmetic applicator 10, is held to the subject, the smaller the circular spray patterns of droplets will be, while as the cosmetic applicator 10 is pulled away from the subject, the circular pattern of droplets will become larger.

Each component works in unison and each component cannot work without the other. The uniqueness of this invention becomes evident by its versatility. This cosmetic applicator can operate in safe environments or harsh environments alike. Using the principles and properties of ultrasonics integrated with a simple machine while using a method of changing and securing fluids, I was able to provide a hand-generated pressure mechanism to improve the way makeup is applied today.

In good faith, I the inventor, am demonstrating the ability to atomize cosmetics using an ultrasonic atomizer that is commonly known and manufactured by Sonaer. Other configurations can be made to the cosmetic applicator such as adding additional features like hand grips, a hand trigger, a desktop holder, and the like. I am demonstrating and teaching the ability to spray liquids, cosmetics and solutions, without the use of pumps, compressors, and tubing that is commonly needed with air brushes and other inventions cited in this disclosure. A unique mechanism has been designed that will enable ultrasonic energy to release cosmetics or solutions for the spraying of fine droplets on to the face or body by a means that is portable and easy to use, efficient by nature since it uses less solution, and more accurate since it is lightweight and has no attachments thus making the end result more captivating.

| Part Identifications Numbers | |
|---|---|
| 10 | Cosmetic Applicator |
| 20 | Back Cover |
| 25 | Elastic Bulb |
| 30 | Frontal Control Mechanism |
| 40 | Liquid Delivery Well |
| 45 | Bottle |
| 50 | Liquid Delivery Orifice |
| 60 | Distal End |
| 90 | Rear Driver |
| 100 | Piezoceramics |
| 110 | Batteries |
| 115 | One Way Check Valve |
| 120 | Circuit Board |
| 130 | Atomizer Device |
| 140 | Front Driver |
| 145 | Air Tube |
| 150 | Distal Tip End |
| 155 | Contact |
| 160 | Spring |
| 165 | Side |
| 168 | Counter Bore |

-continued

| Part Identifications Numbers | |
|---|---|
| 170 | Valve Switch Plate |
| 180 | Valve Pin |
| 200 | Roll Pin |
| 210 | Distal End |
| 215 | Near End |
| 220 | Electrical Contact |
| 225 | Electrical Contact Top |
| 230 | Electrical Contact |
| 235 | Electrical Contact Bottom |
| 240 | Counter Bore |
| 245 | Electrical Contact Middle |
| 250 | Pivoting Slot |
| 260 | Roll Pin Hole |
| 270 | Valve Relief Hole |
| 290 | Pivoting Boss |
| 315 | Side of Valve Switch Plate |
| 325 | Through-Hole |
| 335 | Opposite End |
| 350 | Distal Tip Portion |
| 360 | Liquid Orifice |
| 420 | Electronics Compartment |
| 430 | Transducer Channel |
| 435 | Air Channel |
| 445 | Air Channel Into Bottle |
| 490 | Fine Droplets |
| 510 | Index Finger |
| 530 | Thumb |
| 540 | Hand |

The invention claimed is:

1. A cosmetic applicator comprising:

an ultrasonic device to atomize a cosmetic liquid held in a delivery well via a vibrating distal tip, the device comprising:

a longitudinal main body having a proximal end and a distal end;

a rear cover located at the proximal end;

a frontal control mechanism, wherein the delivery well is located on the frontal control mechanism at the distal end of the main body;

a liquid delivery orifice at a distal end of the control mechanism, the delivery well having a valve relief hole at a bottom of the well configured to meter the cosmetic liquid onto the vibrating distal tip, wherein the vibrating distal tip being located at a distal end of the frontal control mechanism;

a valve switch plate assembly comprising:

a longitudinal valve switch plate having a proximal end and a distal end;

a valve pin attaching to the valve relief hole;

a roll pin configured to pivot the valve switch plate on a vertical axis defining a fulcrum;

a spring biasing the valve switch plate against the main body of the ultrasonic device, a piezoelectric ceramic at the proximal end of the main body; and wherein the piezoelectric ceramic is connected to a circuit board and batteries located at the proximal end of the main body;

a bottle attached to the liquid delivery well;

wherein said liquid delivery well houses the bottle which contains the cosmetic liquid or solution to be sprayed; and wherein the valve pin is configured to open and close an orifice that bridges from the distal end of the frontal control mechanism to the bottle, allowing cosmetics or solutions to flow through the orifice from the bottle onto the distal tip of the atomizer device.

2. The cosmetic applicator of claim 1, wherein the distal end of the valve switch plate has a pressed state and an unpressed state, wherein in the pressed state, the device is configured to generate ultrasonic vibration at the vibrating distal tip, and the valve switch plate unplugs the valve relief hole such that the cosmetic liquid is delivered on to the vibrating distal tip.

3. The cosmetic applicator of claim 1, wherein the cosmetic liquid is configured to be discharged via the liquid delivery orifice in small particles by the ultrasonic vibration of the vibrating distal tip.

4. The cosmetic applicator of claim 1 wherein solution flow is enhanced by:

a pressurizing mechanism comprising;

an elastic bulb, a one-way check valve, and an air tube wherein each part is affixed to the other;

an air tube firmly affixed to the elastic bulb;

an elastic bulb affixed to the rear cover, wherein by squeezing or pushing the elastic bulb with one's fingers towards the rear cover, air is compressed within a cavity made in the bulb;

a one-way check valve wherein air is injected through the air tube mounted inside the frontal control mechanism and deposited within the liquid delivery well pressurizing the cosmetics or solution within the bottle;

wherein the one way check valve only allows air to move through in one direction wherein pressure is maintained within the bottle due to its design.

* * * * *